US009536416B2

(12) United States Patent
Spahl et al.

(10) Patent No.: US 9,536,416 B2
(45) Date of Patent: Jan. 3, 2017

(54) REMINDER APPARATUS AND METHOD FOR ITEMS LEFT IN A VEHICLE

(71) Applicant: FORD GLOBAL TECHNOLOGIES, LLC, Dearborn, MI (US)

(72) Inventors: Robert Spahl, Cologne (DE); Stephen David Fleming, Hockley (GB)

(73) Assignee: Ford Global Technologies, LLC, Dearborn, MI (US)

( * ) Notice: Subject to any disclaimer, the term of this patent is extended or adjusted under 35 U.S.C. 154(b) by 226 days.

(21) Appl. No.: 14/489,034

(22) Filed: Sep. 17, 2014

(65) Prior Publication Data

US 2015/0077253 A1 Mar. 19, 2015

(30) Foreign Application Priority Data

Sep. 17, 2013 (GB) ..... 1316479.3

(51) Int. Cl.

| | |
|---|---|
| ***G08B 13/14*** | (2006.01) |
| ***G08B 21/24*** | (2006.01) |
| ***G07C 9/00*** | (2006.01) |
| *G08B 1/00* | (2006.01) |

(52) U.S. Cl.

CPC ..... *G08B 21/24* (2013.01); *G07C 9/00182* (2013.01); *G07C 9/00309* (2013.01); *G07C 2009/00261* (2013.01); *G07C 2009/00793* (2013.01); *G07C 2209/63* (2013.01); *G08B 1/00* (2013.01)

(58) Field of Classification Search

CPC ..... B60K 1/00; G08B 1/00

See application file for complete search history.

(56) References Cited

U.S. PATENT DOCUMENTS

2010/0188226 A1 7/2010 Seder et al.
2013/0009766 A1* 1/2013 Shaw ..... B60N 2/26 340/457

(Continued)

FOREIGN PATENT DOCUMENTS

DE 102004008181 A1 9/2005

OTHER PUBLICATIONS

Intellectual Property Office, Search Report for the corresponding GB Patent Application No. GB1316479.3 mailed Jan. 20, 2014.

*Primary Examiner* — Shirley Lu

(74) *Attorney, Agent, or Firm* — Frank A. MacKenzie; Brooks Kushman P.C.

(57) ABSTRACT

A vehicle has an interior antenna for detecting transmissions from a keyless entry device (KED) and/or a radio frequency device (RFD) associated with a portable item when inside the vehicle, and an exterior antenna for detecting transmissions from the KED and/or the RFD when outside the vehicle. A processor receives determines, based on transmissions received by the interior and exterior antennas, passing of the KED from inside to outside the vehicle, and generates an alert if the interior antenna detects the RFD remaining inside the vehicle after said passing. The processor may further determine passing of the RFD from outside to inside the vehicle based upon detection by the exterior antenna of transmissions indicating the RFD is outside the vehicle, and subsequent detection by the interior antenna of transmissions from the RFD indicating it is inside the vehicle.

19 Claims, 1 Drawing Sheet

(56) References Cited

U.S. PATENT DOCUMENTS

| | | | | |
|---|---|---|---|---|
| 2013/0054095 | A1* | 2/2013 | Suzuki | B60R 25/245 701/48 |
| 2015/0061856 | A1* | 3/2015 | Raman | G08B 21/24 340/457 |

* cited by examiner

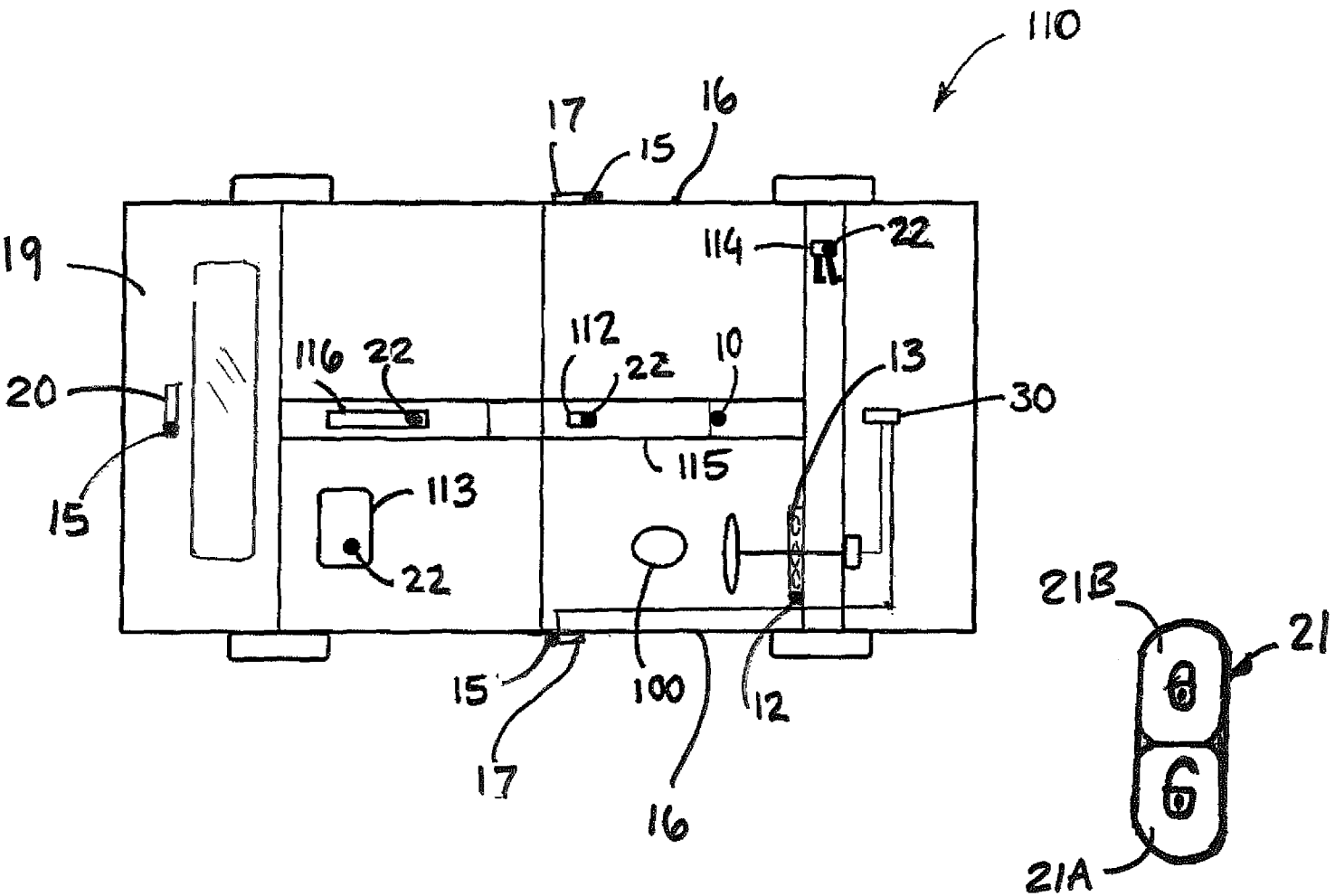
110
21
21B
21A
30
22
13
12
114
10
115
16
15
17
112
100
113
116
19
20

REMINDER APPARATUS AND METHOD FOR ITEMS LEFT IN A VEHICLE

CROSS-REFERENCE TO RELATED APPLICATIONS

This application claims foreign priority benefits under 35 U.S.C. §119(a)-(d) to GB 1316479.3 filed Sep. 17, 2013, which is hereby incorporated by reference in its entirety.

TECHNICAL FIELD

The present invention relates to an apparatus and method for reminding a user leaving a vehicle of the presence of an item in the vehicle. In particular, the invention relates to an apparatus and method of delta tracking items entering a vehicle, items exiting the vehicle and alerting a driver of a vehicle with regards to any of items remaining in the vehicle.

BACKGROUND

Radio frequency (RF) technology is commonly used for remote keyless entry systems whereby a handheld remote control device is used to lock and unlock a vehicle. For example the vehicle can be locked or unlocked by activation of the handheld device or automatically when the handheld device is within a predetermined distance of the vehicle.

Vehicle users can forget to take personal items that they have temporarily stored in their vehicle when they later leave the vehicle. This can cause the user significant inconvenience and annoyance. Also, the forgotten item may have a significant value and may be visible, which could encourage a thief to attempt to break into the vehicle. Typical items often left in a vehicle include a mobile phone, wallet, laptop computer, house keys or sunglasses.

Known radio frequency identification (RFID) systems have been used to locate, track and/or identify items in a wide range of applications. Such systems are wireless and non-contact; they use radio frequency electromagnetic fields to transfer data from a tag attached to the item. The tag contains electronically-stored information which may be read by a user using a reader device. The tag can be passive (it does not require a battery) and is powered and read at short ranges using an active reader. When used for locating or tracking, typically the user is informed by the reader when the item enters the range of the reader. However, RFID systems allow only one-way communication (from the tag at the item to the reader being operated by the user).

In US 2010/0188226 (GM GLOBAL TECH OPERATIONS INC), a system and method are described where the vehicle user, when entering the vehicle, is notified that a particular item is missing, where the item is part of a predetermined group of items.

Near field communication (NFC) devices are a development of RFID technology, where NFC devices allow two-way communication. To date, NFC devices have been used mainly for electronic payment/debit systems, smart cards, key fobs and the like. Many modern smartphones can operate as an active NFC device (for sending or receiving data).

SUMMARY

It is desirable to arrive at an improved system to locate and identify portable items remaining in a vehicle when the vehicle is vacated.

Accordingly, a first aspect of the present invention provides a reminder apparatus configured to alert a user, upon leaving a vehicle, to the presence of one or more portable items within the vehicle, the apparatus comprising:

a first antenna device located within the vehicle;

a second antenna device located external to the vehicle;

a radio frequency device associated with each portable item;

a keyless entry device;

an in-vehicle processor configured to control and communicate the presence of a portable item in the vehicle; and means to output an alert;

wherein the first antenna device is configured to establish communication with the keyless entry device and each radio frequency device when the keyless entry device and each radio frequency device is inside the vehicle and the second antenna device is configured to establish communication with the keyless entry device and each radio frequency device when the keyless entry device and each radio frequency device is outside the vehicle; wherein, in use, a signal from the keyless entry device and each radio frequency device is picked up by each of the first and second antenna devices as the keyless entry device and each radio frequency device enters and/or leaves the vehicle respectively; and wherein, in use, the processor is configured to operate the means to output an alert when one or more radio frequency devices remain in the vehicle and when one of more radio frequency devices have exited the vehicle.

The first disclosed embodiment therefore provides a reminder apparatus that utilises RF technology that is normally associated with keyless entry activation, but expands the utility of RF technology to alert a driver when he leaves the vehicle and where one or more portable items associated with a RF device are left in the vehicle.

Advantageously, unlike NFC based systems, Bluetooth and RFID systems, the disclosed system utilises and expands the utility of existing hardware in a vehicle that operates using RF technology for keyless entry. As such the systems existing utility can be expanded to track portable items that are fitted with and act as signal only RF devices.

A radio frequency device may be attached to a portable item.

A radio frequency device may be embedded in a portable item.

The radio frequency devices associated with each portable item may be configured to send and receive signals only. In contrast, the keyless entry device may be configured to facilitate locking and unlocking the vehicle.

The radio frequency devices associated with each portable item may be configured to send and receive signals only upon operation of the keyless entry device to unlock the vehicle, wherein the external antenna device is configured to pick up a signal from each of the radio frequency devices associated with each portable item when the portable items are on the outside of the vehicle and the internal antenna device is configured to pick up a signal from each of the radio frequency devices associated with each portable item when the portable items pass to the inside of the vehicle.

The apparatus may further comprise a tracking device configured to track multiple portable items simultaneously as the portable items move from the exterior of the vehicle to the interior of the vehicle and from the interior of the vehicle to the exterior of the vehicle. Tracking movement of the portable items therefore means in the event that the user leaves the vehicle and leaves one item behind, for example a laptop, the apparatus according to the present invention will compare the items identified on entering the vehicle with the items leaving the vehicle and will assess if there is a mismatch. If there is a mismatch the user will be alerted The apparatus may be configured to operate the alert in one or more of the following situations: one or more portable items remain in the vehicle and one or more devices exit the vehicle;

one or more portable items remain in the vehicle and one or more devices exit the vehicle and the vehicle door is closed;

the keyless entry device remains in the vehicle and the door is closed;

the keyless entry device exits the vehicle and one or more portable items remain in the vehicle; and the keyless entry device exits the vehicle and one or more portable items remain in the vehicle and the door is closed.

The apparatus may be configured such that activation of the keyless entry device to lock the vehicle disables the alert.

Each portable item may be identified by the exterior antenna at the exterior of the vehicle by signal transfer, subsequently on entry to the vehicle each portable item may be identified by the interior antenna by signal transfer.

The apparatus may be configured such that the an initial alert is activated in view of one or more portable items, but not all portable items remaining in the vehicle when the user exits the vehicle and a secondary alert may be activated in the event that one or more portable items remain in the vehicle when the vehicle door is closed. For example, the secondary alert may comprise increasing volume of an audible signal.

The apparatus may be configured to output an alert when all portable items remain in the vehicle and a journey completion event has been confirmed.

It will be appreciated that often a user deliberately leaves one or more portable items in a vehicle, for example to close a garage door. The apparatus may be configured such that an alert is output when the vehicle door is closed and some or all portable items remain in the vehicle. The apparatus may be configured such that that any alert ceases when the vehicle is locked.

The apparatus may be configured such that an alert does not sound when the keyless entry device remains in the vehicle.

The in-vehicle processor may be configured to output the alert in response to a journey completion event.

The journey completion event may comprise switching off of the vehicle engine. The journey completion event may further comprise the driver of the vehicle vacating the driver's seat, wherein the driver's seat includes a sensor operable to sense and generate a signal to indicate that the seat status has changed from occupied to vacant.

The journey completion event may comprise the vehicle ignition being switched off. The ignition system may comprise a sensor operable to sense and generate a signal to indicate that the ignition status has changed from on to off.

The journey completion event may comprise opening and closing of the driver's door. The driver's door may comprise a sensor operable to sense and generate a signal to indicate that the door status has changed from closed to open. The door sensor may be operable to sense and generate a signal to indicate that the door status has changed from closed to open to closed.

The in-vehicle processor may be configured to communicate with one or more sensors, each of the sensors being operable to indicate the occurrence of a journey completion event and wherein when the sensor indicates that a journey completion event has occurred and when one or more items remain in the vehicle the in-vehicle processor is configured to control when and if an alert is output.

The alert may be one or more of an audible sound, visual or haptic.

For example, an audible alert may be provided by one or more of the vehicle in built systems, for example a horn or an alarm. A visual alert may be provided, for example by illuminating a light, for example the one or more interior lights or external lights. A visual alert may comprise an instrument panel graphic providing details of the item left behind. A haptic alert may be provided, for example by vibration of, for example a mobile device configured to operate as part of the apparatus.

A second aspect of the present invention provides a method of alerting a user upon leaving a vehicle to the presence of one or more portable items within the vehicle, the method comprising:

providing a first antenna device located within the vehicle;

providing a second antenna device located external to the vehicle;

providing a radio frequency device associated with each portable item;

providing a keyless entry device;

providing means to output an alert;

establishing communication by a signal between the first antenna device, the keyless entry device and each radio frequency device when the keyless entry device and each radio frequency device enters the vehicle and establishing communication by a signal between the second antenna device, the keyless entry device and each radio frequency device when the keyless entry device and each radio frequency device exits the vehicle;

wherein, in use, a signal from the keyless entry device and each radio frequency device is picked up by each of the first and second antenna devices as the keyless entry device and each radio frequency device enters and/or leaves the vehicle respectively; and tracking if one or more radio frequency devices remain in the vehicle and if one or more radio frequency devices have exited the vehicle outputting and alert.

Embodiments of the present invention will now be described, by way of example only, with reference to the accompanying drawings in which.

BRIEF DESCRIPTION OF THE DRAWINGS

FIG. 1 schematically illustrates a vehicle comprising a reminder apparatus according to embodiments of the present invention

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Referring to FIG. 1, a schematic representation of a vehicle 110 is illustrated. The vehicle 110 includes a reminder apparatus configured to remind a user, in particular a driver 100, leaving the vehicle of the presence of one or more portable items 112, 113, 114 and 116 within the vehicle 110.

The reminder apparatus comprises a radio frequency (RF) unit 10 which is located within the vehicle 110 and a first antenna 12 which is located inside the vehicle 110. In the illustrated example the first antenna 12 is located in the instrument panel 13. A second antenna 15 is located to the exterior of the vehicle, for example one antenna 15 is located on each of the front doors 16, for example in the exterior door handle 17. An exterior antenna 15 may also be provided in the tailgate 19, for example in the exterior handle 20.

FIG. 1 also shows a keyless entry device 21 carried by driver 100, for example a key fob, and multiple RF devices 22*a*, 22*b*, 22*c*, 22*d* attached to (or otherwise collocated with) respective portable items to be tracked 112, 113, 114, 116. The illustrated example includes four portable items to be tracked. Each item is inside the vehicle 110. The illustrated examples are as follows: a mobile telephone 112, a laptop 113, a set of keys (for example house keys) 114 and a tablet device 116.

From the above description, it will be appreciated that the items, to which the RF devices 22*a-d* are attached or fitted, can take various forms; some electronic and some non-electronic. As such the RF devices 22*a*-22*d* can be provided as an insert, attachment or an embedded part of a portable item. For example, the RF device can be added to an item in a manner similar to attaching a tag or key ring.

The RF devices 22*a*-22*d* associated with the tracked portable items are configured to send and receive RF signals.

In use, before the driver 100 enters the vehicle 110, when the driver 100 is outside the vehicle 110 carrying or transporting one or more of the portable items 112, 113, 114, 116. He unlocks the door 16 of the vehicle 110 using the key fob 21. In the illustrated example the vehicle 110 is unlocked by the driver depressing the unlock button 21A on the key fob 21.

When the driver presses the unlock button 21A, the RF system sends a request "Are you there?" The key fob 21 responds with a response "here I am", and generally the correct security code. One of the exterior antennae 15 of the RF system picks up the response transmitted by key for 21. If the key fob 21 is correctly identified, the system unlocks the doors 16, 19. The system knows the key fob 21 is there, and also knows its location with respect to which antenna 15 picked up the strongest signal.

The RF system can identify movement, hence location of the key fob 21 during entry and exit, because when the key fob 21 is outside the vehicle 110 and the driver 100 unlocks the vehicle 110 the exterior antenna 15 in at least one of the door handles, 17, 20 picks up the strongest signal, which indicates that the key fob 21 is outside the vehicle 110. Subsequently, as the driver 100 enters the vehicle 110, the interior antenna 12 starts picking up the signal also. When the driver 100 and key fob 21 are fully inside the vehicle 110 and the doors 16 are closed, the exterior antennae 15 no longer pick up the signal but the interior antenna 12 does, thus the system now knows that the key fob 21 is inside the vehicle 110. Similarly the system can track when the key fob 21 leaves the vehicle 110, as the driver 100 exits the vehicle 110.

Embodiments of the present invention utilize the RF unit 10 to track movement of the additional RF devices 22*a*-22*d* associated with each of the portable items entering and exiting the vehicle 110, for example a mobile phone 112, laptop, 113, keys 114 and tablet 116.

When the driver 100 approaches the vehicle 110 and unlocks the vehicle 110 with the key fob 21 at least one of the exterior antennae 15 picks up a signal from the key fob 21 and each of the RF devices 22*a*-22*d* associated with each of the items 112, 113, 114, 116 about to enter the vehicle 110. As the key fob 21, the mobile phone 112, laptop 113, keys 14 and tablet 116 move into the vehicle 110 the signal picked up by the exterior antennae 15 weakens and the signal picked up by the interior antenna strengthens. When the door 16 is closed the exterior antennae 15 no longer pick up a signal from the RF devices 22. Therefore, a clear signal is picked up by the interior antenna 12 and the system "knows" that all portable items are inside the vehicle 110.

In the event that the driver 100 exits the vehicle 110 with all items; the key fob 21, the mobile phone 112, the laptop 113, the keys 114 and the tablet 116 the exterior antenna 15 picks up a signal from the key fob 21 and the RF devices 22*a*-22*d* associated with the 112, 113, 114, 116. As such the RF system "knows" that all portable items have exited the vehicle 110. Therefore, no alert is output.

However, when the driver 100 exits the vehicle 110 and leaves one or more items behind, for example the mobile phone 112 and the keys 114, the interior antenna 12 continues to pick up the signal of the RF devices 22 associated with the mobile phone 112 and the keys 114. The exterior antenna picks up the signal of those items that exit the vehicle 110, for example the key fob 21, the laptop 113 and the tablet 116. Delta tracking indicates that there is a mismatch between what has entered the vehicle 110 and what has exited the vehicle 110. Therefore, an alert is output to indicate to the driver 100 that portable items have been left in the vehicle 110.

The alert may be output as a two-stage reminder, where a first reminder may include an audible signal. Alternatively or in addition the first signal may be output via an instrument panel display 13. If the driver 100 ignores the first reminder and subsequently closes the vehicle door 16 the signal may be amplified, for example the volume of an audible alert may increase. Alternatively or in addition exterior lights may be activated or indicator lights may flash. An audible signal may be provided by sounding the horn.

If leaving the items behind is intentional the system according to embodiments of the present invention ceases the alert when the vehicle 110 is locked. In the illustrated example, the driver 100 can lock the vehicle 110 by depressing button 21A on the key fob 21.

In the event that all portable items 112, 113, 114, 116, including the key fob 21 remain in the vehicle 110, by default, an alert may not be output because if the key fob 21 remains in the vehicle 110 the driver 100 is unable to lock the vehicle 110. As such the driver's 100 own curiosity about the whereabouts of the key fob 21 will lead to the driver 100 retrieving the key fob 21 from the vehicle 110.

An in-vehicle processor associated with the RF system may allow the driver 100 to select the type of alert that is output in the event that one or more items remain inside the vehicle 110. The in-vehicle processor may allow the driver to control the volume of an audible signal, control the maximum volume, for example when an exterior horn is used and legislation dictates the maximum volume. The driver 100 may also control other types of alert, for example activation of exterior lights, for example flashing side indicators. As such the driver 100 can customize how an alert is output In the illustrated embodiment, the reminder apparatus also includes a controller 30 on-board the vehicle 110. The controller 30 is configured to control if and when an alert can be output as derived from the signal pick-up between the antennae 12, 15 and the RF devices 22, including the key fob 21.

The controller 30 may be connected to various sensors (not illustrated) in the vehicle 110, for example door sensors, to control when an alert should be output and to control when the alert should stop in the event that portable items remain in the vehicle. For example an alert is output when one or more portable items remain in the vehicle and the door is closed, but the alert stops when the door is locked.

The controller may also communicate with an internal alarm or an external alarm to send a signal or alert to the driver 100 that items remain in the vehicle 110. For example, the reminder apparatus may be connected to the vehicle alarm which can be programmed to respond to a signal from the controller that some or all of the items entering the vehicle remain in the vehicle when tracking the RF devices as they cross between the border from interior to exterior.

The alert signal can be audible, for example a siren or horn, visual, for example flashing lights or an instrument display or haptic, for example a mobile telephone device may vibrate. The alert can be a combination of audible, visual and haptic.

While specific embodiments of the present invention have been described above, it will be appreciated that departures from the described embodiments may still fall within the scope of the present invention. While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. Apparatus for alerting a user to presence of an item in a vehicle, comprising:

an exterior antenna for detecting transmissions from a keyless entry device (KED) and a radio frequency device (RFD) associated with the item when outside the vehicle;

an interior antenna for detecting transmissions from the RFD when inside the vehicle;

a tracking device for tracking the item based at least in part on a difference between signal strengths detected at the exterior antenna and the interior antenna; and a processor configured to determine, based on transmissions received by the interior and exterior antennas, passing of the KED from inside to outside the vehicle, and to generate an alert if the interior antenna detects the RFD remaining inside the vehicle after said passing.

2. The apparatus of claim 1, wherein the processor is further configured to determine passing of the RFD from outside to inside the vehicle based upon:

detection by the exterior antenna of transmissions by the RFD indicating the RFD is outside the vehicle, and subsequent detection by the interior antenna of transmissions from the RFD indicating the item is inside the vehicle.

3. The apparatus of claim 2, wherein the transmissions by the RFD are in response to operation of the KED to unlock the vehicle.

4. The apparatus of claim 1, wherein the processor is further operative to generate a second alert if, after the interior antenna detects the RFD remaining inside the vehicle after said passing, a vehicle door sensor indicates a vehicle door closing.

5. The apparatus of claim 1, wherein the processor is further operative to disable the alert in response to operation of the KED to lock the vehicle.

6. The apparatus of claim 1, wherein the processor is further operative to generate an alert when transmissions from the RFD received by the interior antenna indicate that the item remains inside the vehicle and a signal from a vehicle sensor indicates that a journey completion event has occurred.

7. The apparatus of claim 6, wherein the journey completion event comprises at least one of:

switching off of a vehicle engine;

a driver of the vehicle vacating a driver's seat; and opening and closing of a driver's door.

8. The apparatus of claim 1, wherein the alert is at least one of an audible, a visual, and a haptic alert.

9. A method of alerting a user to an item remaining in a vehicle, comprising:

detecting, at an exterior antenna, radio frequency device (RFD) transmissions associated with the item;

tracking the item when an interior antenna detects the RFD transmissions and the exterior antenna no longer detects the RFD transmissions; and issuing an alert when the exterior antenna detects keyless entry device (KED) transmissions and the interior antenna detects the RFD transmissions.

10. The method of claim 9, further comprising:

using the exterior antenna, detecting transmissions from the RFD indicating the RFD is outside the vehicle;

using the interior antenna to subsequently detect transmissions from the RFD indicating the RFD is inside the vehicle; and determining therefrom a passing of the RFD from outside to inside the vehicle.

11. The method of claim 10, wherein the transmissions by the RFD are in response to operation of the KED to unlock the vehicle.

12. The method of claim 9, further comprising:

issuing a second alert if, after the interior antenna detects the RFD remaining inside the vehicle after said passing, a vehicle door sensor indicates a vehicle door closing.

13. The method of claim 9, further comprising:

disabling the alert in response to operation of the KED to lock the vehicle.

14. The method of claim 9, further comprising:

issuing an alert if transmissions from the RFD received by the interior antenna indicate that the item remains inside the vehicle and a signal from a vehicle sensor indicates that a journey completion event has occurred.

15. The method of claim 9, further comprising:

issuing a secondary alert if, after the interior antenna detects the RFD remaining inside, a vehicle door is closed.

16. The method of claim 9, wherein the alert is at least one of an audible, a visual, and a haptic alert.

17. A method of determining that a user has left an item in a vehicle, comprising:

operating an interior antenna to detect transmissions from a keyless entry device (KED) and a radio frequency device (RFD) associated with the item inside the vehicle, wherein the transmissions by the RFD are in response to operation of the KED to unlock the vehicle;

operating an exterior antenna to detect transmissions from the KED outside the vehicle;

tracking the item based at least in part on a difference between signal strengths detected at the exterior antenna and the interior antenna; and operating a processor to issue an alert when the exterior antenna detects transmissions from the KED and when the interior antenna detects transmissions from the RFD.

18. The method of claim 17, further comprising:

disabling the alert in response to operation of the KED to lock the vehicle.

19. The method of claim 17, further comprising:

issuing a second alert if, after the interior antenna detects the RFD remaining inside the vehicle after said passing of the KED, a vehicle door sensor indicates a vehicle door closing.

* * * * *